US006804975B2

(12) United States Patent
Park

(10) Patent No.: US 6,804,975 B2
(45) Date of Patent: Oct. 19, 2004

(54) AIR CONDITIONING APPARATUS

(76) Inventor: Choon-Kyoung Park, 105-101 Hyundai Apt. 481 Gaebong, 2-dong, Guro-gu, 152-755 Seoul (KR)

( * ) Notice: Subject to any disclaimer, the term of this patent is extended or adjusted under 35 U.S.C. 154(b) by 0 days.

(21) Appl. No.: 10/332,072

(22) PCT Filed: Nov. 30, 2001

(86) PCT No.: PCT/KR01/02071

§ 371 (c)(1),
(2), (4) Date: Jan. 2, 2003

(87) PCT Pub. No.: WO03/046440

PCT Pub. Date: Jun. 5, 2003

(65) Prior Publication Data

US 2004/0045304 A1 Mar. 11, 2004

(51) Int. Cl.[7] ..... F25B 13/00; F25B 27/00; F25D 17/04; F25D 17/06

(52) U.S. Cl. ..... 62/324.1; 62/187; 62/238.7; 62/426; 62/427; 62/428

(58) Field of Search ..... 62/238.7, 426–428, 62/324.1, 187

(56) References Cited

U.S. PATENT DOCUMENTS 3,995,446 A * 12/1976 Eubank ..... 62/325
5,533,357 A * 7/1996 Voorhis ..... 62/277
6,038,879 A * 3/2000 Turcotte et al. ..... 62/325
6,619,063 B1 * 9/2003 Brumett ..... 62/264

FOREIGN PATENT DOCUMENTS

| | | |
|---|---|---|
| JP | 57-62333 | 4/1982 |
| JP | 62-119334 | 5/1987 |
| JP | 62-237231 | 10/1987 |
| JP | 5-272782 | 10/1993 |
| JP | 6-347058 | 12/1994 |
| JP | 7-55185 | 3/1995 |

* cited by examiner

*Primary Examiner*—William Doerrler
*Assistant Examiner*—Filip Zec
(74) *Attorney, Agent, or Firm*—Dann, Dorfman, Herrell and Skillman, P.C.; Henry H. Skillman

(57) ABSTRACT

Disclosed is a cooling-heating combination air conditioner being provided with an outdoor heat exchanger and an indoor heat exchanger in a single case. The present invention has advantages of freely adjusting a ventilation rate from 0% to 100% with its simple structure without equipping a separate ventilator, and improving efficiency in cooling and heating effectively by recovering an air discharged during a ventilation process and a waste energy of condensed water generated in the indoor heat exchanger and by maximizing a path along which a coolant is circulated according to cooling-heating mode conversion.

6 Claims, 6 Drawing Sheets

AIR CONDITIONING APPARATUS

TECHNICAL FIELD

The present invention relates to an air conditioner, and more particularly, to a cooling-heating combination type air conditioner capable of improving cooling and heating efficiency, in which the degree of ventilation may be freely adjusted depending upon the condition of indoor air, with no an additional ventilation equipment being provided, in which waste energy contained in the discharged air and condensate water produced in an evaporator is effectively recycled, and in which a circulation course of a coolant is optimized upon changeover between cooling and heating.

BACKGROUND ART

As well known in the art, a vapor compression-type cooling system capable of functioning as a heat pump when actuating in a reverse cycle is greatly increasing its popularity in the recent, since a restricted indoor space can be efficiently utilized by selectively carrying out cooling or heating of a room without separate installation of a cooler and a heater if a cooling-heating combination-type air conditioner is installed to obtain cooling and heat pump cycles in a single apparatus.

FIGS. 1 and 2 are conceptual views of an operation cycle of a heat pump and cooling-heating combination-type air conditioner, in which FIG. 1 illustrates a circulation process in cooling, and FIG. 2 illustrates a circulation process in heating. As shown in FIG. 1, where coolant exhausted from a compressor 1 is circulated in the air conditioner in the order of a four-way valve 2, an outdoor heat exchanger 3, an expansion valve 4 and an indoor heat exchanger 5, the indoor heat exchanger 5 functions as an evaporator so that a cold liquid coolant introduced into the indoor heat exchanger 5 sucks heat from the indoor air to evaporate into gas while flowing through the inside of the indoor heat exchanger 5, thereby cooling the indoor air. As shown in FIG. 2, where the four-way valve 2 is switched so that the coolant exhausted from the compressor 1 is circulated in the air conditioner in the order of the four-way valve 2, the indoor heat exchanger 5, the expansion valve 4 and the outdoor heat exchanger 3, the indoor heat exchanger 5 functions as a condenser so that hot gaseous coolant introduced into the indoor heat exchanger 5 radiates heat into the indoor air to condense into liquid while flowing through the inside of the indoor heat exchanger 5, thereby heating the indoor air.

In the heat pump and cooling-heating combination-type air conditioner, the outdoor heat exchanger is generally installed outdoor as separately manufactured from an indoor unit and disadvantageously consumes a large amount of time and endeavor for treatment and installation. Although several types of air conditioners have been proposed each of which has an indoor heat exchanger and an outdoor heat exchanger in a single housing in order to overcome these problems, they have not been put to practical use yet since their have complicated constructions and are expensive.

Further, where a ventilation function is added to an apparatus to actively ventilate indoor air, the apparatus is increased in weight and size and complicated in construction thereby elevating manufacturing cost. Also there is a problem that cooling-heating efficiency is very low since this apparatus fails to effectively recycle thermal energy contained in cooled or heated air which is exhausted from the room in ventilation.

As set forth above, the indoor heat exchanger and the outdoor heat exchanger function as an evaporator and a condenser, respectively, in cooling operation. The outdoor heat exchanger 3 for receiving coolant in gaseous state and discharging the same in liquid state has a number of tubes 33 fixed to a frame 34 for connecting between cylindrical headers 31 and 32 and heat exchange fins between tubes. In the indoor heat exchanger 5 functioning as the evaporator, if a header is installed in the inlet side, liquid coolant introduced into the header in the inlet side through the expansion valve 4 collects in a lower portion of the header owing to gravity without feeding to tubes in a higher portion of the header thereby dropping cooling efficiency. In order to prevent this problem, the indoor heat exchanger replaces the header in the inlet side with a distributor 51 for uniformly introducing liquid coolant into each of the tubes. The distributor 51 is free from bias of liquid coolant since it is smaller in height and volume compared to the header.

According to this construction, as shown in FIG. 1, in introducing liquid coolant toward the indoor heat exchanger 5 functioning as an evaporator in cooling during summer, liquid coolant is uniformly fed into each of the tubes via the distributor 51 to elevate cooling efficiency. However, where this apparatus is converted into a heating mode during winter as shown in FIG. 2, the indoor heat exchanger 5 functioning as the condenser receives gaseous coolant having a high temperature and pressure and then discharges liquid coolant having a high temperature and pressure is discharged while the outdoor heat exchanger 3 functioning as the evaporator receives liquid coolant having a low temperature and pressure flown from the expansion valve 4 and then discharges gaseous liquid. Liquid coolant introduced into the header 32 in the inlet side of the outdoor heat exchanger 3 is collected in a lower portion of the header under gravity. This insufficiently feeds to the tubes in a high portion of the header so that liquid coolant may not have a sufficient amount of heat exchange with the ambient air. Also the distributor 51 having a low volume and micro tubes in the outlet side of the indoor heat exchanger 5 increase conduit resistance in respect to high liquid coolant discharged from the indoor heat exchanger. These things coact to remarkably degrade heating efficiency.

Further, in conversion of the cooling and heating functions, gaseous coolant conduits exchange their function with liquid coolant conduits so that gas conduits convert into liquid conduits while liquid conduits convert into gas conduits. Thus it is difficult to obtain the optimum conduit features according to coolant state and thus coolant does not smoothly flow frequently causing breakdown.

DISCLOSURE OF THE INVENTION

The present invention has been made to solve the foregoing problems and it is therefore an object of the present invention to provide an air conditioner having an outdoor heat exchanger and an indoor heat exchanger in a single housing, by which the degree of ventilation can be freely adjusted in the range of 0 to 100% using a simple construction without any additional ventilation equipment while energy in indoor air which is exhausted in ventilation can be effectively recycled.

It is another object of the invention to provide an air conditioner capable of optimizing a circulation course of coolant according to cooling-heating conversion to remarkably improve cooling-heating efficiency thereby downsizing the apparatus and preventing breakdown of conduit trains according to cooling-heating conversion.

According to an aspect of the invention to obtain the above objects, it is provided an air conditioner including a compressor, an outdoor heat exchanger, expansion valves and an indoor heat exchanger, and carrying out cooling and heating processes by switching circulation direction of a coolant through a four-way valve, the apparatus comprising: an indoor air exhaust chamber having the indoor heat exchanger for performing heat exchange between the coolant and air, an intake blower for supplying air in a room, and an indoor air outlet functioning as a channel through which the intake blower feeds air into the room; an outdoor air exhaust chamber having the outdoor heat exchanger for performing heat exchange between the coolant and the air, an exhaust blower for exhausting the air, and an outdoor air outlet functioning as a channel through which the exhaust blower exhausts the air to the outdoors; an indoor air suction chamber connected to the indoor air exhaust chamber and the outdoor air exhaust chamber via an indoor air circulation damper and an indoor air exhaust damper, respectively, which are adjustable in opening ratio, and having an indoor air suction port functioning as a channel for introducing indoor air which is sucked under suction force of the intake blower and/or the exhaust blower; an outdoor air suction chamber connected to the indoor air exhaust chamber, and the outdoor air exhaust chamber via an outdoor air feeding damper and an outdoor air exhaust damper, respectively, which are adjustable in opening ratio, and having an outdoor air suction port functioning as a channel for introducing outdoor air which is sucked under suction force of the exhaust blower and/or the intake blower; and a single housing for containing the indoor air exhaust chamber, the outdoor air exhaust chamber, the indoor air suction chamber and the outdoor air suction chamber.

In the air conditioner of the invention having the above construction, the quantity of exhausting indoor air can be freely regulated by adjusting the relative opening ratio of the indoor air circulation damper and the indoor air exhaust damper while the quantity of introducing outdoor air can be freely regulated by adjusting the relative opening ratio of the outdoor air feeding damper and the outdoor air exhaust damper so as to carry out the optimum air conditioning according the condition of indoor and outdoor air. Also, indoor and outdoor air can be distributed and fed toward a room and the outdoors under suction force of the intake blower and the exhaust blower without installation of separate fan for ventilation so as to minimize the size and weight of the apparatus.

Further, direct heat exchange is established between the outdoor heat exchanger functioning as the hot condenser and exhaust air for ventilation having a relatively low temperature in cooling ventilation while direct heat exchange is established between the outdoor heat exchanger functioning as the cold evaporator and exhaust air for ventilation having a relatively high temperature so that thermal energy can be recycled by the maximum quantity from exhaust air for ventilation.

It is preferred that the indoor air exhaust chamber is installed in the housing adjacent to an upper end thereof, the indoor air outlet exposed in a front portion of the housing, wherein the outdoor air exhaust chamber is installed in the housing adjacent to a lower end thereof, the outdoor air outlet exposed in a rear portion of the housing, wherein the indoor air suction chamber is installed between the indoor air exhaust chamber and the outdoor air exhaust chamber with the indoor air circulation chamber as a partition from the indoor air exhaust chamber and the outdoor air exhaust chamber as a partition from the outdoor air exhaust chamber, the indoor air suction port exposed in a front portion of the housing, and wherein the outdoor air suction chamber is installed in the rear of the indoor air suction chamber between the indoor air exhaust chamber and the outdoor air exhaust chamber with the outdoor air feeding chamber as a partition from the indoor air exhaust chamber and the outdoor air exhaust chamber as a partition from the outdoor air exhaust chamber, in which the outdoor air suction port is exposed in a rear portion of the housing.

The above construction can more simplify and downsize the apparatus of the invention as well as efficiently utilize a restricted floor space so that the apparatus can be applied to a compact air conditioner as a home appliance.

In the air conditioner of the invention, the indoor air suction chamber is L-shaped to form an extended portion bounding on a front portion of the outdoor air exhaust chamber, the indoor air suction port disposed in the extended portion adjacent to a lower end thereof, whereby air exhausted into the room via the indoor air outlet can be sucked in an upper portion of the apparatus and air sucked via the indoor air suction port can be sucked in a lower portion of the apparatus so that any interference between exhaust air and suction air is avoided thereby enabling effective circulation of indoor air.

According to another aspect of the invention to obtain the above objects, the air conditioner of the invention may further comprise: a condensate water reservoir under the indoor heat exchanger and having a condensate water pump for discharging condensate water from the condensate water reservoir under a high pressure; a condensate water outlet under the outdoor heat exchanger; and a condensate water injector over the outdoor heat exchanger, the condensate water injector communicating with the condensate water pump in a discharging side thereof via a condensate water feeding conduit for injecting condensate water from the condensate water pump toward the outdoor heat exchanger, whereby condensate water produced in the indoor heat exchanger functioning as the evaporator in cooling can be actively utilized for cooling the outdoor heat exchanger to elevate cooling efficiency. Further, if the condensate water pump is simply operated when the level of condensate water reaches a given value, a time period of pump suspension is prolonged dropping the cooling efficiency of the outdoor heat exchanger owing to condensate water. It is preferred that the air conditioner of the invention further comprises a control unit for turning on/off the condensate water pump for a given time period if detection means shows the level of condensate water at least a reference value in order to uniformly regulate the condensate water pump for a long time period.

According to a further another aspect of the invention to obtain the above objects, in the air conditioner of the invention, the outdoor heat exchanger and the indoor heat exchanger each includes: a pair of headers to which coolant conduits are connected, respectively, and a number of heat exchange tubes coupled between the headers for functioning as channels through which coolant introduced to one header is fed to the other header, and the air conditioner may further comprise: hollow distributors each disposed between each of the indoor and outdoor heat exchangers and each of the expansion valves, the each distributor having a first end coupled to a coolant conduit and a second end coupled to a number of distribution tubes, wherein the distribution tubes of the each distributor are coupled to ends of the heat exchange tubes of the each heat exchanger, respectively, so as to form a coolant cycle so that coolant is distributed into corresponding ones of the heat exchange tubes via the coolant conduits of the each distributor when introduced into the each heat exchanger from each of the expansion valves, and discharged via the coolant conduits of the each header when discharged toward the each expansion valve via the each heat exchanger in the cooling and heating processes according to switching of the four-way valve. With the air conditioner of the invention, regardless of whether the air conditioner is operated in a cooling or heating cycle, gaseous coolant having a large value of specific volume is circulated only through the coolant conduits of the headers, liquid coolant introduced toward the heat exchangers is uniformly distributed to the heat exchange tubes via the distributor and the distribution tubes, and liquid coolant exhausted from the heat exchangers is exhausted via the coolant conduits of the headers so as to constitute the cooling/heating cycle with the minimum quantity of conduit resistance. Cooling and heating efficiency of the cooling-heating combination type air conditioner can be improved at the same time so as to downsize the apparatus as well as prevent breakdown of conduit trains according to cooling-heating conversion.

BRIEF DESCRIPTION OF THE DRAWINGS

The above and other objects, features and other advantages of the present invention will be more clearly understood from the following detailed description taken in conjunction with the accompanying drawings, in which:

FIGS. 6 and 7 illustrate coolant circulation processes according to a heating cycle of the invention, in which FIG. 6 illustrates a coolant circulation process in cooling, and FIG. 7 illustrates a coolant circulation process in heating.

BEST MODE FOR CARRYING OUT THE INVENTION

Figure 1:
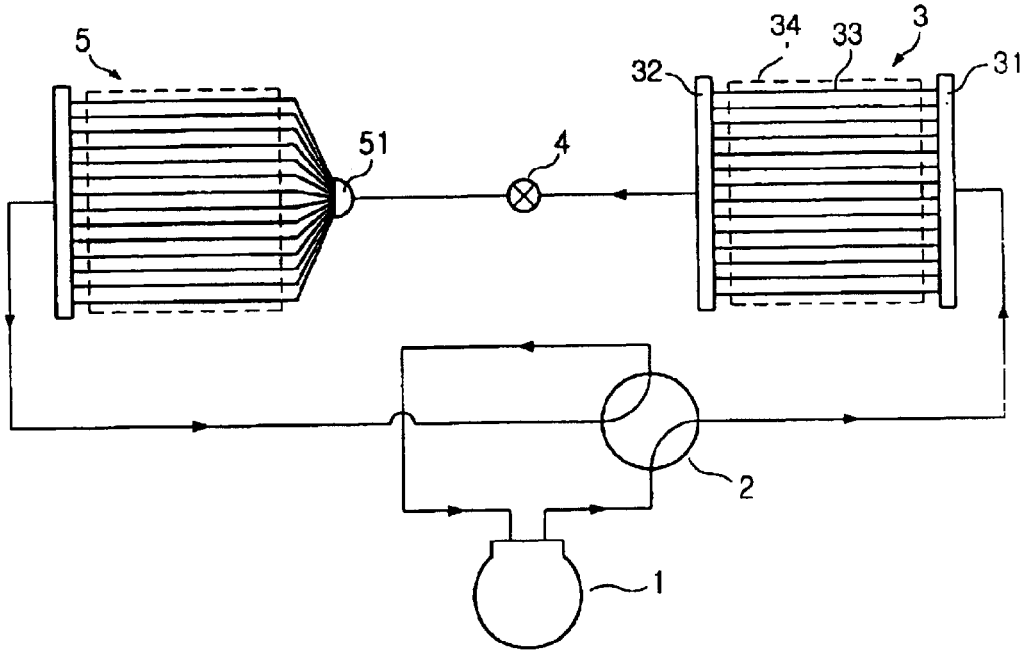
FIG. 1 is a conceptual view of a coolant circulation process in a heat pump and cooling-heating combination type air conditioner in cooling.
Figure 2:
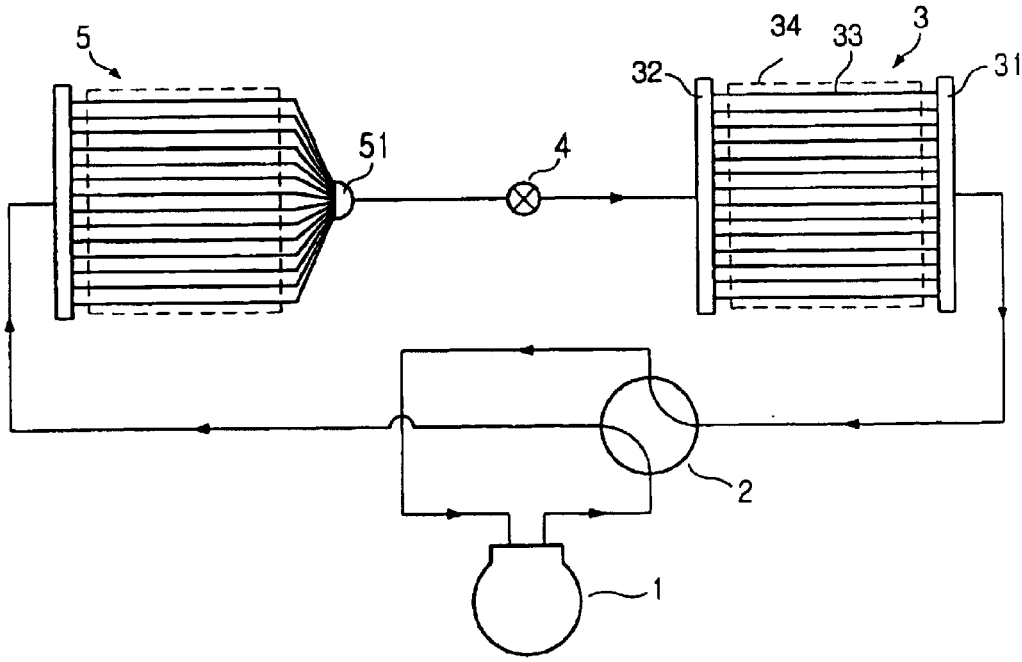
FIG. 2 is a conceptual view of a coolant circulation process in a heat pump and cooling-heating combination type air conditioner in heating.
Figure 3:
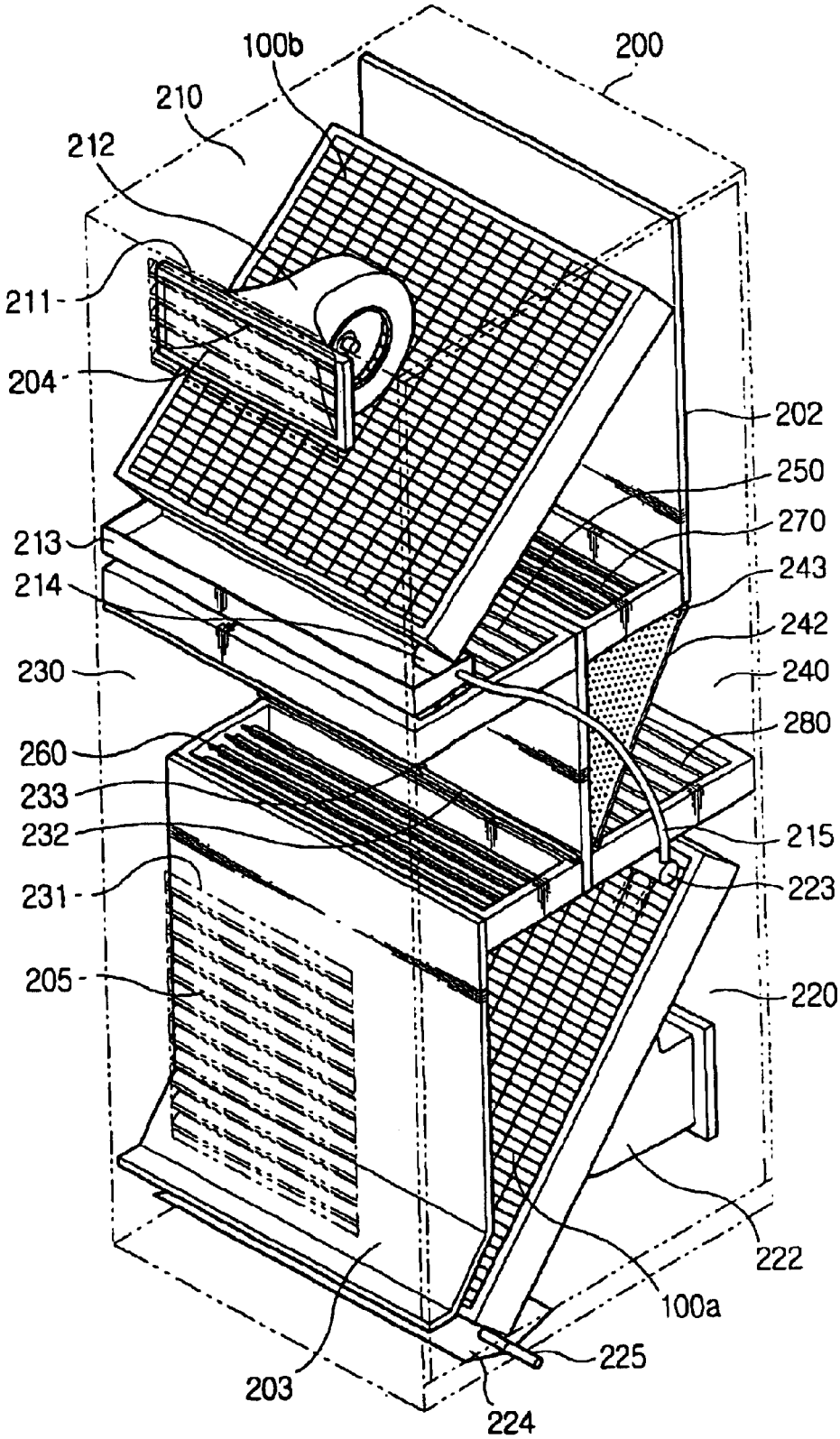
FIG. 3 is a perspective view of important parts in an air conditioner according to a preferred embodiment of the invention.
Figure 4:
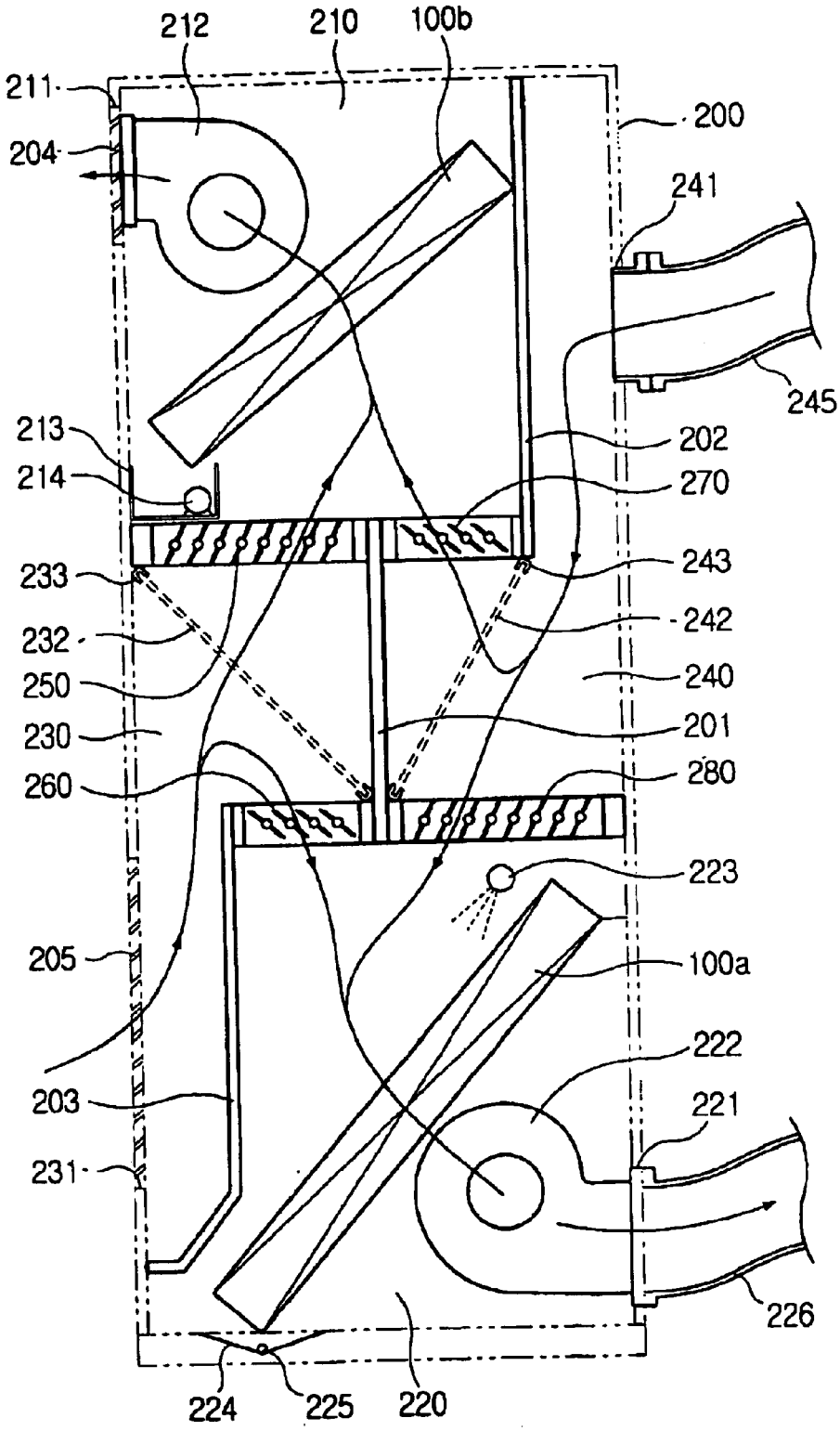
FIG. 4 is a longitudinal sectional view of an operation state in carrying out a ventilation function.
Figure 5:
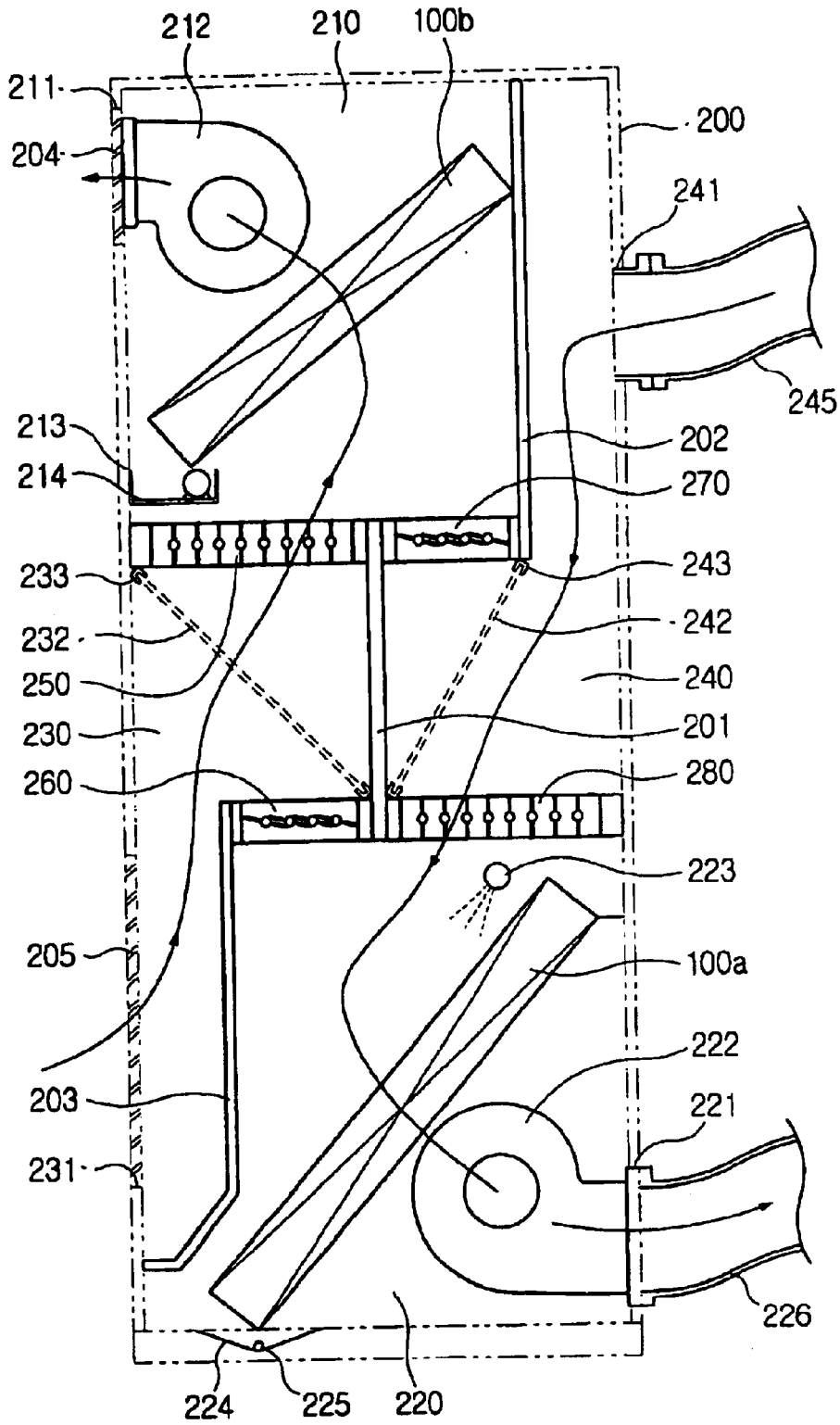
FIG. 5 is a longitudinal sectional view of an operation state when the ventilation function is suspended.
Figure 6:
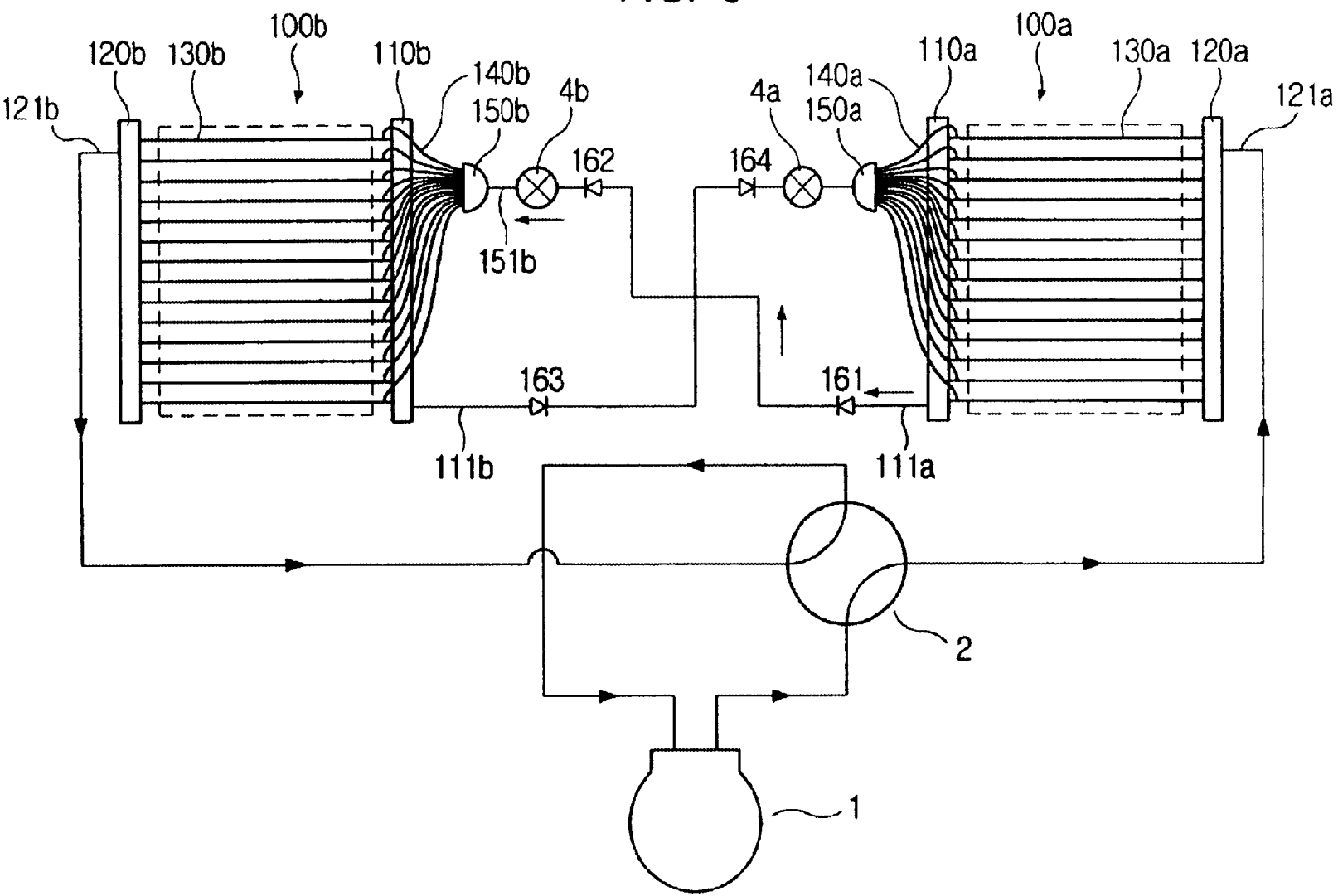
Figure 7:
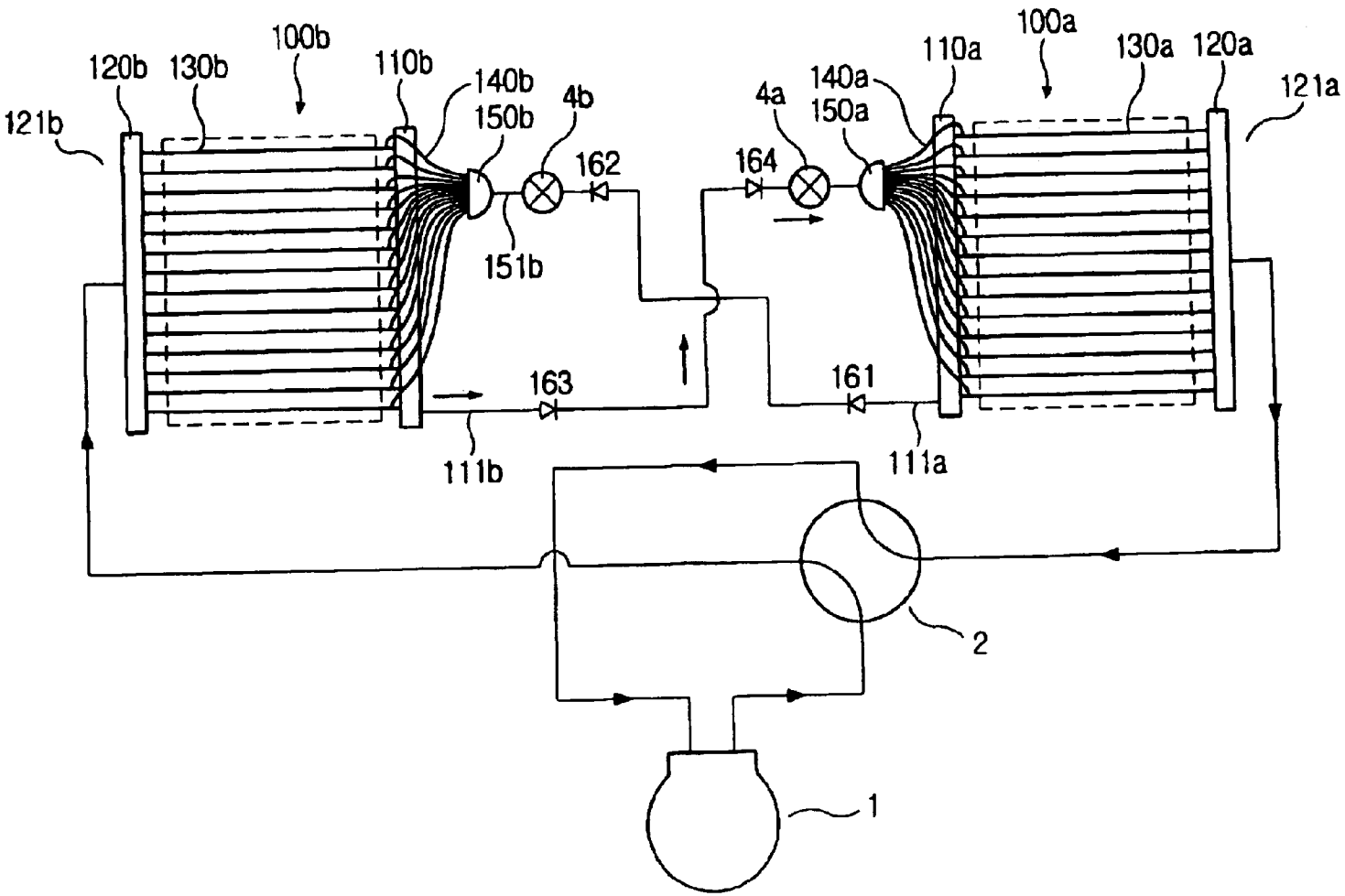

The following detailed description will present a preferred embodiment of the invention in reference to the accompanying drawings, in which FIG. 3 is a perspective view of important parts in an air conditioner according to a preferred embodiment of the invention; FIG. 4 is a longitudinal sectional view of an operation state in carrying out a ventilation function; FIG. 5 is a longitudinal sectional view of an operation state when the ventilation function is suspended; FIG. 6 is a conceptual view of a coolant circulation process in the air conditioner of the invention in cooling, and FIG. 7 is a conceptual view of a coolant circulation process in the air conditioner of the invention in heating.

The air conditioner of the invention has a compressor 1, a four-way valve 2, an outdoor heat exchanger 100*a*, expansion valves 162 and 164 and an indoor heat exchanger 100*b*, and as shown in FIGS. 5 and 6, switches the circulation direction of coolant via the four-way valve 2 to carry out cooling and heating. The air conditioner also includes an indoor air exhaust chamber 210, an outdoor air exhaust chamber 220, an indoor air suction chamber 230 and an outdoor air suction chamber 240 in a single housing 200. The indoor air exhaust chamber 210 internally has the indoor heat exchanger 100*b* for performing heat exchange with air, an intake blower 212 for sucking in heat-exchanged air and an indoor air outlet 211 functioning as a channel through which the intake blower 212 feeds air into a room. The outdoor air exhaust chamber 220 internally has the outdoor heat exchanger 100*a* for performing heat exchange with air, an exhaust blower 222 for exhausting heat-exchanged air, and an outdoor air outlet 221 functioning as a channel through which the exhaust blower 222 exhausts air to the outdoors. The indoor air suction chamber 230 is connected to the indoor air exhaust chamber 210 and the outdoor air exhaust chamber 220 via an indoor air circulation damper 250 and an indoor air exhaust damper 260, respectively, which are adjustable in opening ratio with a number of blades. The indoor air suction chamber 230 has an indoor air suction port 231 functioning as a channel for introducing indoor air which is sucked under suction force mainly of the intake blower 212 and additionally of the exhaust blower 222 according to the degree of opening of the indoor air circulation damper 250 and the indoor air exhaust damper 260. The outdoor air suction chamber 240 is connected to the indoor air exhaust chamber 210 and the outdoor air exhaust chamber 220 via an outdoor air feeding damper 270 and an outdoor air exhaust damper 280, respectively, which are adjustable in opening ratio with a number of blades. The outdoor air suction chamber 240 has an outdoor air suction port 241 functioning as a channel for introducing outdoor air which is sucked under suction force mainly of the exhaust blower 222 and additionally of the intake blower 212 according to the degree of opening of the outdoor air feeding damper 270 and the outdoor air exhaust damper 280. In the construction as above, each of the chambers is bounded by inside walls of the housing 200, a damper 201 and partitions 202 and 203 allowing the apparatus to have a simple and compact construction. In this embodiment, the indoor air exhaust chamber 210 is installed in the housing 200 adjacent to the upper end thereof with the indoor air outlet 211 exposed in a front portion of the housing 200 while the outdoor air exhaust chamber 220 is installed in the housing 200 adjacent to the lower end thereof with the outdoor air outlet 221 exposed in a rear portion of the housing 200.

The indoor air suction chamber 230 is installed between the indoor air exhaust chamber 210 and the outdoor air exhaust chamber 220 with the indoor air circulation chamber 250 as a partition from the indoor air exhaust chamber 210 and the outdoor air exhaust chamber 260 as a partition from the outdoor air exhaust chamber 220. The indoor air suction chamber 230 has an inner space which is L-shaped by the partition 203 to form an extended portion bounding on the front portion of the outdoor exhaust chamber 220, in which the indoor air suction port 231 is disposed in the extended portion adjacent to the lower end thereof. This construction allows the air conditioner to feed to the indoor air via the indoor air outlet 211 in an upper portion thereof and suck air via the indoor air suction port 231 in a lower portion thereof, thereby avoiding any interference between exhaust air and suction air so as to circulate indoor air efficiently.

The outdoor air suction chamber 240 is installed in the rear of the indoor air suction chamber 230 between the indoor air exhaust chamber 210 and the outdoor air exhaust chamber 220 with the outdoor air feeding chamber 270 as a partition from the indoor air exhaust chamber 210 and the outdoor air exhaust chamber 280 as a partition from the outdoor air exhaust chamber 220. The outdoor air suction chamber 240 has an inner space which is L-shaped by the partition 202 to form an extended portion bounding on the rear portion of the indoor air exhaust chamber 210, in which the outdoor air suction port 241 is disposed in the extended portion adjacent to the upper end thereof.

The outdoor air suction port 241 and the outdoor air outlet 221 communicated with the outside via ducts 245 and 246, respectively. The indoor air outlet 211 and the indoor air suction port 231 have grills 203 and 204, respectively. Inside the indoor air suction chamber 230 and the outdoor air suction chamber 240, air-cleaning filters 232 and 242 are slidably installed in brackets 233 and 243, respectively.

The air conditioner also includes a condensate water reservoir 213 under the indoor heat exchanger 100*b* and a condensate water outlet 225 under the outdoor heat exchanger 100*a*. The condensate water reservoir 213 has a condensate water pump 214 for discharging condensate water from the condensate water reservoir 213 under a high pressure. The air conditioner also includes a condensate water injector 223 over the outdoor heat exchanger 100*a*, which communicates with the condensate water pump 214 in the discharging side thereof via a condensate water feeding conduit 215 for injecting condensate water from the condensate water pump 214 toward the outdoor heat exchanger 100*a*. This construction allows condensate water obtained from the indoor heat exchanger 100*b* functioning as an evaporator in cooling to be actively utilized for cooling the outdoor heat exchanger thereby improving cooling efficiency.

In controlling the operation of the condensate water pump, if the condensate water pump is simply operated when the level of condensate water reaches a given value, a time period of pump suspension is prolonged dropping the cooling efficiency of the outdoor heat exchanger owing to condensate water.

Preferably, in order to uniformly regulate the condensate water pump 214, the air conditioner of the invention also includes a control unit which turns on/off the condensate water pump 214 for a given time period if the level of condensate water shows at least a reference value when it is detected by detection means for condensate water level. It is also preferred that the condensate water reservoir 213 is provided narrow and elongated in its longitudinal direction.

As shown in FIGS. 6 and 7, the outdoor heat exchanger 100*a* and the indoor heat exchanger 100*b* of the invention each include a pair of headers 110*a*, 120*a* or 110*b*, 120*b* to which coolant conduits 111*a*, 121*a* or 111*b*, 121*b* are connected respectively and a number of heat exchange tubes 130*a* or 130*b* coupled between the headers 110*a*, 120*a* or 110*b*, 120*b* for functioning as channels through which coolant introduced to one header is fed to the other header. Between the outdoor heat exchanger 100*a* and the expansion valve 4*a*, a hollow distributor 151*a* is installed which has a coolant conduit 151*a* coupled to one end thereof and a number of distribution tubes 140*a* coupled to the other end thereof. Between the outdoor heat exchanger 110*b* and the expansion valve 4*b*, a hollow distributor 151*b* is installed which has a coolant conduit 151*b* coupled to one end thereof and a number of distribution tubes 140*b* coupled to the other end thereof. The distribution tubes 140*a* and 140*b* of the distributors 150*a* and 150*b* are coupled to one ends of the heat exchange tubes 130*a* and 130*b* of the heat exchangers 100*a* and 100*b*, respectively. In the heat exchangers 100*a* and 100*b* and the distributors 150*a* and 150*b*, the coolant conduits 111*a* and 151*b* are coupled to the expansion valve 4*b* via check valves 161 and 162 while the coolant conduits 111*b* and 151*a* are coupled to the expansion valve 4*a* via check valves 163 and 164. In cooling and heating according to switching operation of the four-way valve 2, when coolant is introduced into any of the heat exchangers from the corresponding expansion valve, coolant is distributed into the heat exchange tubes via the coolant conduits of the corresponding distributor. On the other hand, when coolant is discharged toward any of the expansion valves via the corresponding heat exchanger, coolant is discharged via the coolant conduits of the corresponding header.

Hereinafter the operation of the air conditioner according to the embodiment of the invention having the above construction will be described in reference to air flows in FIGS. 4 and 5 and coolant flows in FIGS. 6 and 7.

First, as shown in FIG. 6 illustrating a coolant circulation process in cooling, coolant discharged from the compressor is circulated through the air conditioner in the order of the outdoor heat exchanger 100*a*, the expansion valve 4*b* and the indoor heat exchanger 100*b*, in which the outdoor heat exchanger 100*a* functions as a condenser and the indoor heat exchanger 100*b* functions as an evaporator.

Describing the process in more detail, hot gaseous coolant having high pressure discharged from the compressor 1 is collected in the second header 120*a* of the outdoor heat exchanger 100*a* via the four-way valve 2 switched into a cooling mode and the coolant conduits 121*a* of the outdoor heat exchanger 100*a* and then fed into the heat exchange tubes 130*a*. Coolant is converted into liquid having an intermediate temperature and pressure through heat exchange with the outdoor air while passing through each of the heat exchange tubes 130*a*.

The heat exchange tubes 130*a* of the outdoor heat exchanger 100*a* communicate with the first header 110*a*, and also with the distributor 150*a* branched by the distribution tubes 140*a*. However, the check valve 164 is installed adjacent to the coolant conduit 151*a* of the distributor 150*a* in an orientation closing against discharge of coolant while the check valve 161 is installed adjacent to the coolant conduit 111*a* of the first header 110*a* in an orientation opening for discharge of coolant so that liquid coolant having the intermediate temperature and pressure discharged from the heat exchange tubes 130*a* can be fed toward the expansion valve 4*b* via the coolant conduit 111*a* of the first header 110*a* which has a remarkably small magnitude of conduit resistance compared to a course passing the distribution tubes 140*a* and the distributor 150*a*. Also the coolant conduit 111*a* is connected to the first header 110*a* adjacent to the lower end thereof so that liquid coolant only is efficiently fed toward the expansion valve 4*b*.

After converted into the liquid state having the intermediate temperature and pressure through the outdoor heat exchanger 100*a*, coolant undergoes throttling expansion while passing through the expansion valve 4*b* or capillary tubes to convert into liquid having a low temperature and pressure (i.e. saturated vapor state containing a small amount of gas in practice) and then uniformly introduced into each of the heat exchange tubes 130*b* of the indoor heat exchanger 100*b*. After being introduced into the indoor heat exchanger 100*b*, liquid coolant having intermediate temperature evaporates into a low pressure state through heat exchange with the indoor air while passing through the heat exchange tubes 130*b* and then sucked into the compressor 1 through the second header 120*b* and the coolant conduit 121*b*.

The indoor and outdoor air circulates as shown in FIGS. 4 and 5 to heat the indoor and cool the outdoor heat exchanger, in which FIG. 4 illustrates air flow in which the air conditioner simultaneously carries out cooling and ventilation functions, and FIG. 5 illustrates air flow in which the air conditioner suspends the ventilation function and only carries out the cooling function.

As shown in FIG. 4, when the indoor air circulation damper 250 and the indoor air exhaust damper 260 are opened by properly adjusting the opening ratio with a controller and so on, cold indoor air sucked into the indoor air suction chamber 230 under the suction force of the intake blower 212 and the exhaust blower 222 is divided into the indoor air exhaust chamber 210 and the outdoor air exhaust chamber 220 by the indoor air circulation damper 250 and the indoor air exhaust damper 260. After passing through the indoor air circulating damper 250, air is filtered while passing through the filter 232 and then exchanges heat to cool down while flowing through the indoor heat exchanger 100*b* functioning as the evaporator. Cooled air is re-circulated into the indoor air through the indoor air outlet 211. After passing through the indoor air exhaust damper 260, cold indoor air removes heat from the outdoor heat exchanger 100*a* while passing through the same which is remarkably hotter since it functions as the condenser. After removing heat from the outdoor heat exchanger, air is exhausted outdoors.

In the meantime, when the outdoor air feeding damper 270 and the outdoor air exhaust damper 280 are opened by properly adjusting the opening ratio with the controller and so on, outdoor air sucked into the indoor air suction chamber 240 under the suction force of the exhaust blower 222 and the feeding blower 212 is divided into the indoor air exhaust chamber 210 and the outdoor air exhaust chamber 220 by the outdoor air feeding damper 270 and the outdoor air exhaust damper 280. After passing through the outdoor air feeding damper 270, air is filtered while passing through the filter 242 and then exchanges heat to cool down while flowing through the indoor heat exchanger 100*b* functioning as the evaporator. Cooled air is re-circulated into the indoor air through the indoor air outlet 211 to feed fresh outdoor air into the room. After flowing through the outdoor air exhaust damper 280, outdoor air flows through the outdoor heat exchanger 100*a* functioning as the condenser removing heat therefrom, and then is exhausted outdoors.

In this case, the cooling operation is cooperatively carried out by relatively cold indoor air flown through the indoor air exhaust damper 260 and cold condensate water injected from the condensate water injector 223 in addition to outdoor air introduced through the outdoor door exhaust damper 280 so that coolant can be effectively condensed.

FIG. 5 illustrates a cooling mode in which both of the indoor air exhaust damper 260 and the outdoor air feeding damper 270 are closed and both of the indoor air circulation damper 250 and the outdoor air exhaust damper 280 are opened so that only the cooling function is carried out and the ventilation function is suspended. According to the invention, the degree of ventilation can be freely adjusted in the range of 0 to 100% by properly adjusting the opening ratio of the dampers so that air conditioning can be carried out most properly according to indoor and outdoor air conditions.

Referring to FIG. 7 illustrating a coolant circulation process in heating, coolant exhausted from the compressor 1 is circulated through the air conditioner in the order of the four-way valve 2, the indoor heat exchanger 100*b*, the expansion valve 4*a* and the outdoor heat exchanger 100*a*, in which the indoor heat exchanger 100*b* functions as the condenser and the outdoor heat exchanger 100*a* functions as the evaporator.

Also in heating, gaseous coolant introduced toward the indoor heat exchanger 100*b* functioning as the condenser is distributed into the heat exchange tubes 130*b* via the second header 120*b* while liquid coolant discharged from the indoor heat exchanger 100*b* is fed toward the expansion valve 4*a* via the first header 110*b* so as to minimize conduit resistance.

Further, liquid coolant introduced toward the outdoor heat exchanger 100*a* functioning as the evaporator is uniformly fed into the heat exchange tubes 130*a* via the distributor 150*a* and the distribution tubes 140*a* while gaseous coolant discharged from the outdoor heat exchanger 100*a* is collected in the second header 120*a* and then sucked into the compressor via the coolant conduit 121.

That is to say, discharge of liquid coolant from the heat exchanger as well as suction and discharge of gaseous coolant are carried out via the header in both of the cooling and heating processes so as to minimize conduit resistance against coolant flow. Liquid coolant sucked toward the heat exchanger is uniformly fed to the heat exchange tubes via the distributor and the distribution tubes so as to reliably prevent degradation of heat exchange efficiency owing to bias of liquid coolant.

In the heating process as shown in FIGS. 4 and 5 similar to the cooling process, in addition to outdoor air introduced via the outdoor exhaust damper 280, relatively hot indoor air flown through the indoor air exhaust damper 26 acts on the outdoor heat exchanger 100*a* functioning as the evaporator so that evaporation of coolant can be carried out more effectively.

According to the air conditioner of the invention as set forth above, the outdoor heat exchanger and the indoor heat exchanger are provided in the single housing while the degree of ventilation can be freely adjusted in the range of 0 to 100% with a simple construction without any additional ventilation equipment. Also the invention can recycle air exhausted from ventilation process and waste energy of condensate water produced from the indoor heat exchanger as well as optimize the circulation course of coolant according to switching of cooling and heating processes so as to improve cooling and heating efficiency.

What is claimed is:

1. An air conditioner including a compressor, an outdoor heat exchanger, a four-way valve least two expansion valves and an indoor heat exchanger, and controls for carrying out cooling and heating processes by switching circulation direction of a coolant through said four-way valve, one of said expansion valve effecting expansion of the coolant circulating from the outdoor exchanger to the indoor exchanger, and a second of said expansion valves effecting expansion of the coolant circulation from the indoor exchanger to the outdoor exchanger, the apparatus comprising:

an indoor air exhaust chamber having the indoor heat exchanger for performing heat exchange between the coolant and air, an intake blower for supplying air in a room, and an indoor air outlet functioning as a channel through which the intake blower feeds air into the roam;

an outdoor air exhaust chamber having the outdoor heat exchanger for performing heat exchange between the coolant and the air, an exhaust blower for exhausting the air, and an outdoor air outlet functioning as a channel through which the exhaust blower exhausts the air to the outdoors;

an indoor air suction chamber connected to the indoor air exhaust chamber and the outdoor air exhaust chamber via an indoor air circulation damper and an indoor air exhaust damper, respectively, which are adjustable in opening ratio, and having an indoor air suction port functioning as a channel for introducing indoor air which is sucked under suction force of the intake blower and/or the exhaust blower;

an outdoor air suction chamber connected to the indoor air exhaust chamber and the outdoor air exhaust chamber via an outdoor air feeding damper and an outdoor air exhaust damper, respectively, which are adjustable in opening ratio, and having an outdoor air suction port functioning ass channel for introducing outdoor air which is sucked under suction force of the exhaust blower and/or the intake blower; and a single housing for containing the indoor heat exhaust chamber, the outdoor air exhaust chamber, the indoor air auction chamber and the outdoor air suction chamber, said outdoor heat exchanger and said indoor heat exchanger each including: a pair of headers to which coolant conduits are connected, respectively, and a number of heat exchange tubes coupled between the headers for functioning as channels through which coolant introduced to one header is fed to the other header, hollow distribution each disposed between one of the indoor and outdoor heat exchangers and one of the two expansion valves, each distributor having a first end coupled to a coolant conduit and a second end coupled to a number of distribution tubes, and the distribution tubes of the distributor being coupled to ends of the heat exchange tubes of its respective heat exchanger, so as to form a coolant cycle so that coolant is distributed into corresponding ones of the heat exchange tubes via the coolant conduits of the respective distributor when introduced into the respective heat exchanger from the respective expansion valve, and discharged via the coolant conduits of each header when discharged toward the expansion valve vie the heat exchanger in the cooling and heating processes according to the switching of the four-way valves.

2. The air conditioner in accordance with claim 1, wherein the indoor air exhaust chamber is installed in the housing adjacent to an upper end thereof, the indoor air outlet exposed in a front portion of the housing;

the outdoor air exhaust chamber is installed in the housing adjacent to a lower end thereof, the outdoor air outlet exposed in a mar portion of the housing;

the indoor air auction chamber is installed between the indoor air exhaust chamber end the outdoor air exhaust chamber with the indoor air circulation chamber as a partition from the indoor air exhaust chamber and the outdoor air exhaust chamber as a partition from the outdoor air exhaust chamber, the indoor air suction port exposed in a front portion of the housing; and the outdoor air suction chamber is installed in the rear of the indoor air suction chamber between the indoor air exhaust chamber end the outdoor air exhaust chamber with the outdoor air feeding chamber as a partition from the indoor air exhaust chamber and the outdoor air exhaust chamber as a partition from the outdoor air exhaust chamber, the outdoor air suction port exposed in a mar portion of the housing.

3. The air conditioner in accordance with claim 2, wherein the indoor air suction chamber is L-shaped to form an extended portion bounding on a front portion of the outdoor air exhaust chamber, the indoor air suction port disposed in the extended portion adjacent to a lower and thereof.

4. The air conditioner in accordance with claim 1, further comprising:

a condensate water reservoir under the indoor heat exchange and having a condensate water pump for discharging condensate water from the condensate water reservoir under a high pressure;

condensate water outlet under the outdoor heat exchanger; and a condensate water injector over the outdoor heat exchanger, the condensate water injector communicating with the condensate water pump in a discharging side thereof via a condensate water feeding conduit for injecting condensate water from the condensate water pump toward the outdoor heat exchanger.

5. The air conditioner in accordance with claim 4, further comprising:

condensate water detecting means in the condensate water reservoir for detecting the level of condensate water contained in the condensate water reservoir; and a control unit for turning on/off the condensate water pump for a given time period if the level of condensate water shows at least a reference value.

6. An air conditioner including a compressor, an outdoor heat exchanger, a four-way valve, expansion valves and an indoor heat exchanger, and controls for carrying out cooling and heating processes by switching circulation direction of a coolant through the four-way valve, the apparatus comprising:

an indoor air exhaust chamber having the indoor heat exchanger for performing heat exchange between the coolant and air, an intake blower for supplying air in a room, and an indoor air outlet functioning as a channel through which the intake blower feeds air into the room;

an outdoor air exhaust chamber having the outdoor heat exchanger for performing heat exchange between the coolant and the air, an exhaust blower for exhausting the air, and an outdoor air outlet functioning as a channel through which the exhaust blower exhausts the alt to the outdoors;

an indoor air suction chamber connected to the indoor air exhaust chamber and the outdoor air exhaust chamber via an indoor air circulation damper and an indoor air exhaust damper, respectively, which are adjustable in opening ratio, and having an indoor air suction port functioning as a channel for introducing indoor air which is sucked under suction force of the intake blower and/or the exhaust blower;

an outdoor air suction chamber connected to the indoor air exhaust chamber and the outdoor air exhaust chamber via an outdoor air feeding damper and an outdoor air exhaust damper, respectively, which are adjustable in opening ratio, and having an outdoor air suction port functioning as a channel for introducing outdoor air which is sucked under suction force of the exhaust blower and/or the intake blower;

a single housing for containing the indoor air exhaust chamber, the outdoor air exhaust chamber, the indoor air suction chamber and the outdoor air suction chamber, a condensate water reservoir under the indoor heat exchanger and having a condensate water pump for discharging condensate water from the condensate water reservoir under a high pressure;

condensate water outlet under the outdoor heat exchanger;

a condensate water injector over the outdoor heat exchanger, the condensate water injector communicating with the condensate water pump in a discharging side thereof via a condensate water feeding conduit for injecting condensate water from the condensate water pump toward the outdoor heat exchanger, condensate water detecting means in the condensate water reservoir for detecting the level of condensate water contained in the condensate water reservoir; and control unit for turning on/off the condensate water pump for a given time period if the level of condensate water shows at least a reference value.

* * * * *

UNITED STATES PATENT AND TRADEMARK OFFICE

CERTIFICATE OF CORRECTION

PATENT NO. : 6,804,975 B2
APPLICATION NO. : 10/332072
DATED : October 19, 2004
INVENTOR(S) : Choon-Kyoung Park It is certified that error appears in the above-identified patent and that said Letters Patent is hereby corrected as shown below:

Column 10

Line 53, “circulation” should be --circulating--;
Line 61, “roam” should be --room--;

Column 11

Line 13, “ass” should be --as a--;
Line 15, after “intake blower;”, delete “and”;
Line 27, “distribution” should be --distributors--;
Line 41, “vie” should be --via--;
Line 50, “mar” should be --rear--;
Line 51, “auction” should be --suction--;
Line 52, “end” should be --and--;
Line 65, “mar” should be --rear--;

Column 12

Line 3, “and” should be --end--;
Line 7, “exchange” should be --exchanger--;
Line 44, “alt” should be --air--;

Column 13

Line 3, before “condensate” insert --a--.

Signed and Sealed this

First Day of July, 2008

JON W. DUDAS
*Director of the United States Patent and Trademark Office*